US007559857B2

(12) United States Patent
Sato et al.

(10) Patent No.: US 7,559,857 B2
(45) Date of Patent: Jul. 14, 2009

(54) GOLF BALL

(75) Inventors: Katsunori Sato, Chichibu (JP); Hiroshi Higuchi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/930,586

(22) Filed: Oct. 31, 2007

(65) Prior Publication Data

US 2009/0111613 A1 Apr. 30, 2009

(51) Int. Cl.
*A63B 37/12* (2006.01)

(52) U.S. Cl. ..... 473/383

(58) Field of Classification Search ..... 473/383–385; D21/708–709
See application file for complete search history.

(56) References Cited

U.S. PATENT DOCUMENTS 4,869,512 A * 9/1989 Nomura et al. ..... 473/383
7,367,905 B2 * 5/2008 Sato et al. ..... 473/383
2005/0043119 A1 * 2/2005 Veilleux et al. ..... 473/383

FOREIGN PATENT DOCUMENTS

| | | | |
|---|---|---|---|
| JP | 08-276035 | A | 10/1996 |
| JP | 10-108921 | A | 4/1998 |
| JP | 2002-534237 | A | 10/2002 |
| JP | 2002-336377 | A | 11/2002 |
| WO | 00/41774 | A1 | 7/2000 |

* cited by examiner

*Primary Examiner*—Raeann Trimiew
(74) *Attorney, Agent, or Firm*—Sughrue Mion, PLLC

(57) ABSTRACT

An object of the present invention is to provide a golf ball having an improved aesthetic appearance and enhanced flying performance. The present invention provides a golf ball on which a plurality of dimples are arranged on the spherical surface thereof, wherein each of the dimples has at least two contour main parts and contour connecting parts, and the at least two contour main parts are connected to each other by the contour connecting parts, and the contour connecting parts are formed so as to be curved toward the inside of the contour main parts from the outermost points.

16 Claims, 6 Drawing Sheets

GOLF BALL

BACKGROUND OF THE INVENTION

The present invention relates to a golf ball having a spherical surface. More particularly, it relates to a golf ball provided with dimples of a characteristic shape on the spherical surface and having excellent flying performance.

For the conventional golf ball, the design freedom for dimples is degraded by the restriction on the fabricating technique such as the structure of a die used for manufacturing the golf ball and the restriction on the performance such as the enhancement of flying performance of golf ball. Therefore, it is difficult to enhance the flying performance of golf ball while dimples having a characteristic shape such as to improve the aesthetic appearance of golf ball are adopted.

In recent years, the performance of golf gear such as a golf ball and a golf club has been enhanced. Therefore, the golf ball is often flied by being hit under a low spin condition, and a low spin condition of about 2000 rpm is not rare. When the golf ball is flied under such a low spin condition, in the region of ball trajectory from hitting to the highest terminal point, a drag, which is an air resistance against the flying golf ball, is small, so that the carry of golf ball increases. However, in a low-speed region after the highest terminal point of ball trajectory, a lift for floating the golf ball cannot be obtained sufficiently, so that the carry of golf ball decreases. Therefore, it has been demanded that the flying performance of golf ball be enhanced by devising the shape of dimples considering the balance between the drag and lift under such a low spin condition.

Next, the relationship between dimples and flying performance is explained. The flying performance can be enhanced by regulating the volume percentage of dimples (total volume of dimples/volume of an imaginary spherical body (imaginary spherical body: a golf ball assumed to have no dimples)), the area percentage of dimples (total area of dimples/surface area of an imaginary spherical surface (imaginary spherical surface: the spherical surface of a golf ball assumed to have no dimples)), or the like for golf balls having various structure. The flying performance can be enhanced by devising the cross-sectional shape of dimples (ratio of depth to diameter of dimple, smoothness, etc.). Further, in the case where a plurality of dimples are arranged on the whole spherical surface of golf ball so as to be symmetrical, high aerodynamic characteristics can be obtained, and therefore the flying performance can be enhanced.

Golf balls having variously shaped dimples are present. The literature relating to such golf balls is cited below. Japanese Unexamined Patent Application Publication No. 2002-534237 discloses a golf ball provided with dimples having a sickle-shaped contour. Japanese Unexamined Patent Application Publication Nos. 8-276035 and 10-108921 disclose a golf ball provided with connecting grooves having a straight line shaped contour, which are arranged so as to connect a plurality of dimples to each other and formed into a concave shape having a depth shallower than the depth of dimple.

However, for the golf ball described in Japanese Unexamined Patent Application Publication No. 2002-534237, the dimples are formed so that the contour of dimple is greatly curved into a sickle shape. In the case where such dimples are arranged at a plurality of locations on the spherical surface of the golf ball, sufficient flying performance is possibly not provided.

For the golf ball described in Japanese Unexamined Patent Application Publication Nos. 8-276035 and 10-108921, the contour of the connecting groove connecting the dimples to each other is of a straight line shape, and not of a streamline and smooth shape. Due to such connecting grooves, the drag at the time when the golf ball is flied may increase, and therefore sufficient flying performance is possibly not provided. The depth of the connecting groove is shallower than the depth of the dimple, and the depths of the dimple and the connecting groove are uneven. Therefore, it is intricate to regulate the volume of dimples by adjusting the dimensions of dimples, so that a golf ball having enhanced flying performance is difficult to manufacture.

SUMMARY OF THE INVENTION

An object of the present invention is to provide a golf ball having an improved aesthetic appearance and enhanced flying performance.

To achieve the above object, the present invention provides golf balls as described below.

(1) A golf ball on which a plurality of dimples are arranged on the spherical surface thereof, wherein each of the dimples has at least two contour main parts and contour connecting parts; and the at least two contour main parts are connected to each other by the contour connecting parts, and the contour connecting parts are formed so as to be curved toward the inside of the contour main parts from the outermost points.

(2) The golf ball described in the item (1), wherein all of the at least two contour main parts each are formed into a circular shape.

(3) The golf ball described in the item (1), wherein the at least two contour main parts are formed by combination of a circular shape and a noncircular shape.

(4) The golf ball described in the item (1), wherein all of the at least two contour main parts each are formed into a noncircular shape.

(5) The golf ball described in the item (1), wherein the number of the dimples is about 150 to 500.

(6) The golf ball described in the item (1), wherein the bottom part of the dimple is formed into a flat shape.

(7) The golf ball described in the item (1), wherein the bottom part of the dimple is formed into a spherical surface shape.

(8) A golf ball on which a plurality of dimples are arranged on the spherical surface thereof, wherein each of the dimples has at least two contour main parts and contour connecting parts; the at least two contour main parts are connected to each other by the contour connecting parts, and the contour connecting parts are formed so as to be curved toward the inside of the contour main parts from the outermost points; and a curved part is provided which is formed so as to be curved toward the center direction of the spherical surface between the contour main parts and contour connecting parts and the bottom part of the dimple.

(9) The golf ball described in the item (8), wherein all of the at least two contour main parts each are formed into a circular shape.

(10) The golf ball described in the item (8), wherein the at least two contour main parts are formed by combination of a circular shape and a noncircular shape.

(11) The golf ball described in the item (8), wherein all of the at least two contour main parts each are formed into a noncircular shape.

(12) The golf ball described in the item (8), wherein the number of the dimples is about 150 to 500.

(13) The golf ball described in the item (8), wherein the bottom part is formed into a flat shape.

(14) The golf ball described in the item (8), wherein the bottom part is formed into a spherical surface shape.

According to the golf ball described in the item (1), the area percentage and volume percentage of the dimples can be changed by the portion surrounded by the contour main parts and the contour connecting parts, so that the lift and the drag can be balanced. Since the contour connecting part has a curved streamline shape, the flow of air can be made smooth between the contour main parts. By changing such a curved shape, the drag etc. can be restrained. Therefore, the lift and the drag acting on the golf ball when the golf ball is flied can be balanced easily. The flying performance of golf ball can be enhanced. The curved contour connecting part has a characteristic shape. By the dimples having the contour connecting parts, the appearance of golf ball can be made characteristic.

According to the golf ball described in the item (2), excellent aerodynamic characteristics are provided, so that the flying performance of golf ball can be enhanced. The dimple has streamline beauty emphasized by the contour main parts formed into a circular shape only and the curved contour connecting parts. By the dimples having such characteristics, the aesthetic appearance of golf ball can be improved further.

According to the golf ball described in the item (3), excellent aerodynamic characteristics are provided, so that the flying performance of golf ball can be enhanced. The dimple has both of a characteristic shape emphasized by the noncircular contour main parts and streamline beauty emphasized by the circular contour main parts and the curved contour connecting parts. By the dimples having such characteristics, the aesthetic appearance of golf ball can be improved further.

According to the golf ball described in the item (4), excellent aerodynamic characteristics are provided, so that the flying performance of golf ball can be enhanced. The dimple has both of a characteristic shape emphasized by the contour main parts formed into a noncircular shape only and streamline beauty emphasized by the curved contour connecting parts. By the dimples having such characteristics, the aesthetic appearance of golf ball can be improved further.

According to the golf ball described in the item (5), the area percentage of the dimples is secured sufficiently, so that the flying performance of golf ball can be enhanced further.

According to the golf ball described in the item (6), the dimple has a characteristic shape due to the flat shaped bottom part. By the dimples having such characteristics, the aesthetic appearance of golf ball can be improved further.

According to the golf ball described in the item (7), further excellent aerodynamic characteristics are provided, so that the flying performance of golf ball can be enhanced. Especially in the case where the bottom part of the dimple is formed into a spherical surface shape of a spherical body having the center at a position approximately equal to the center of the spherical surface, in designing, the volume of the dimple can be changed by adjusting the radius of the spherical surface shape of the bottom part. By adjusting the radius of the spherical surface shape, even if the dimple has an intricate shape as in the present invention, the volume can be adjusted effectively for the golf balls having various structure. Thereby, the lift and the drag acting on the golf ball when the golf ball is flied can be balanced easily, so that the flying performance of the golf ball 1 can be enhanced further.

According to the golf ball described in the item (8), the same effects as those of the golf ball described in the item (1) can be achieved. Further by the curved part curved toward the center direction of the spherical surface between the contour main parts and contour connecting parts and the bottom part, the flow of air on the spherical surface from the dimples is made smooth, so that the drag can be restrained. Therefore, the flying performance of golf ball can be enhanced further.

According to the golf ball described in the item (9), the same effects as those of the golf ball described in the item (2) can be achieved.

According to the golf ball described in the item (10), the same effects as those of the golf ball described in the item (3) can be achieved.

According to the golf ball described in the item (11), the same effects as those of the golf ball described in the item (4) can be achieved.

According to the golf ball described in the item (12), the same effects as those of the golf ball described in the item (5) can be achieved.

According to the golf ball described in the item (13), the same effects as those of the golf ball described in the item (6) can be achieved.

According to the golf ball described in the item (14), the same effects as those of the golf ball described in the item (7) can be achieved.

DESCRIPTION OF THE PREFERRED EMBODIMENTS

Figure 1:
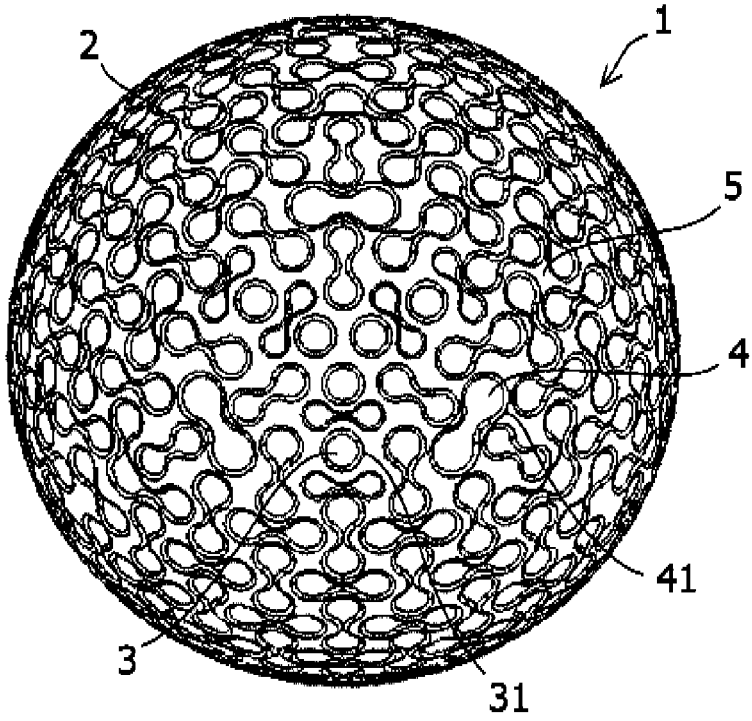
FIG. 1 is a schematic perspective view showing an appearance of a golf ball in a first embodiment of the present invention, also showing an appearance of a golf ball in example 1.

FIG. 1 shows the outline of an appearance of a golf ball 1 in a first embodiment of the present invention. The golf ball 1 has a spherical surface 2. On this spherical surface 2, a plurality of circular dimples 3 are formed, and further a plurality of connecting dimples 4 having a characteristic shape of the present invention are formed. A portion in which the circular dimples 3 and the connecting dimples 4 are not formed forms a land part 5. The circular dimple 3 has a circular contour 31 at the boundary between the circular dimple 3 and the land part 5. The connecting dimple 4 has a contour 41 at the boundary between the connecting dimple 4 and the land part 5.

Figure 2:
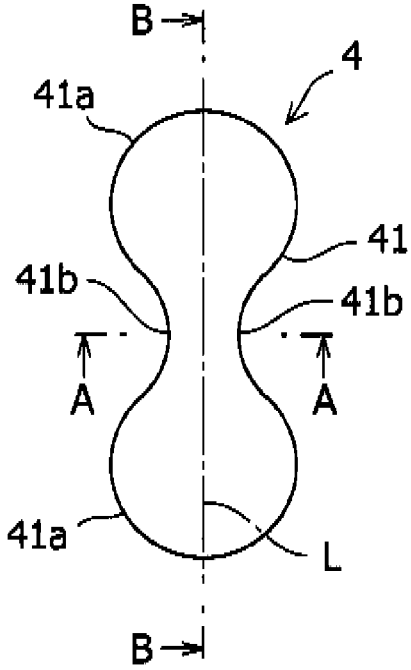
FIG. 2 is a schematic view showing a dimple in a first embodiment of the present invention in a plan view.

FIG. 2 is an enlarged view showing the outline of the connecting dimple 4 having a characteristic shape of the present invention in a plan view. The details of the connecting dimple 4 are explained with reference to FIG. 2. The contour 41 comprises two contour main parts 41*a* and two contour connecting parts 41*b*. The two contour main parts 41*a* each are formed into a substantially circular shape, and are arranged close to each other.

The two contour connecting parts 41*b* connect the two contour main parts 41*a* to each other. Further, the contour connecting part 41*b* is explained in detail by using a longitudinal axis L. The longitudinal axis L is an imaginary line passing through the substantially central parts of the two contour main parts 41*a* and the middle part between the two contour connecting parts 41*b*. In the case where the contour main part 41*a* is defined as a shape projecting toward the direction substantially perpendicular to the longitudinal axis L, and a part projecting farthest from the longitudinal axis L of the shape is defined as an outermost point, the contour connecting part 41*b* is formed into a shape curved toward the inside direction of the contour main parts 41*a* from the outermost points.

A plurality of connecting dimples 4 each having the above-described shape are arranged on the spherical surface 2 of the golf ball 1. The connecting dimples 4 having a plurality of kinds of sizes are arranged.

Therefore, a part surrounded by the contour main parts 41*a* and contour connecting parts 41*b* changes the area percentage and volume percentage of the connecting dimples 4, by which the drag and lift can be balanced. Since the contour connecting parts 41*b* each have a curved streamline shape, the flow of air between the two contour main part 41*a* can be made smooth. By changing the above-described curved shape, the drag can be restrained. When the golf ball is flied, the lift and the drag acting on the golf ball 1 can be balanced easily, whereby the flying performance of the golf ball 1 can be enhanced.

The curved contour connecting part 41*b* has a characteristic shape. By the connecting dimples 4 each having such contour connecting parts 41*b*, the appearance of the golf ball 1 can be made characteristic. Further, the connecting dimple 4 has streamline beauty emphasized by the contour main parts 41*a* formed into a circular shape only and the curved contour connecting parts 41*b*. By the connecting dimples 4 each having the above-described characteristics, the aesthetic appearance of the golf ball 1 can be improved further.

Figure 3A:
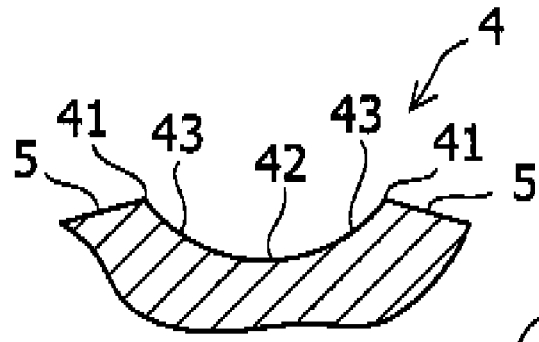
FIG. 3(A) is a sectional view taken along the line A-A of FIG. 2 in a first embodiment.
Figure 3B:
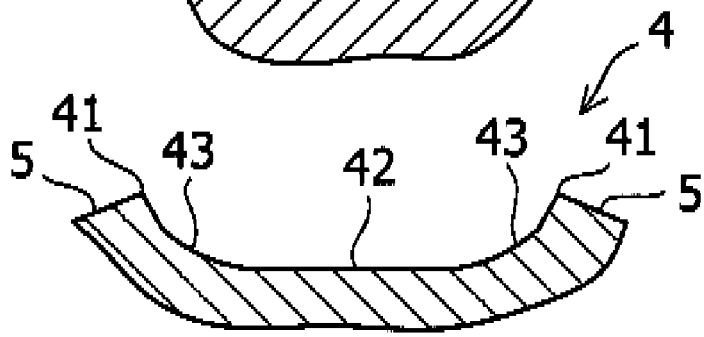
FIG. 3(B) is a sectional view taken along the line B-B of FIG. 2 in a first embodiment.

FIG. 3(A) is a sectional view taken along the line A-A of FIG. 2 in the first embodiment of the present invention. The A-A cross section is a transverse cross section cut perpendicularly to the longitudinal axis L. FIG. 3(B) is a sectional view taken along the line B-B of FIG. 2 in the first embodiment of the present invention. The connecting dimple 4 has a bottom part 42. The bottom part 42 is formed so as to be curved toward the center direction of the spherical surface 2 of the golf ball 1. When viewed as the B-B cross section, the middle part of the bottom part 42 is formed so as to have a substantially uniform depth. Between the bottom part 42 and the contour 41, a curved part 43 is arranged. The curved part 43 is curved toward the center direction of the spherical surface 2 of the golf ball 1. The radius of curvature of the curve of the bottom part 42 is set so as to be approximately equal to the radius of curvature of the curve of the bottom part 42.

By the curved part 43 configured as described above, the flow of air from the connecting dimple 4 to the land part 5 is made smooth, so that the drag can be restrained. Thereby, the flying performance of the golf ball 1 can be enhanced further.

The above is a description of the first embodiment of the present invention. The present invention is not limited to the above-described embodiment, and various modifications and changes can be made based on the technical concept of the present invention. Modifications of the first embodiment are explained below. In the modifications, parts other than those explained below are the same as the parts of the first embodiment.

Figure 4A:
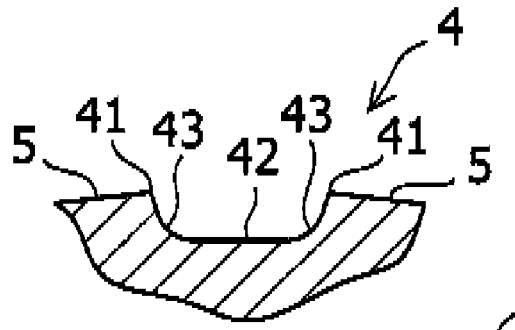
FIG. 4(A) is a sectional view taken along the line A-A of FIG. 2 in a first modification of a first embodiment.
Figure 4B:
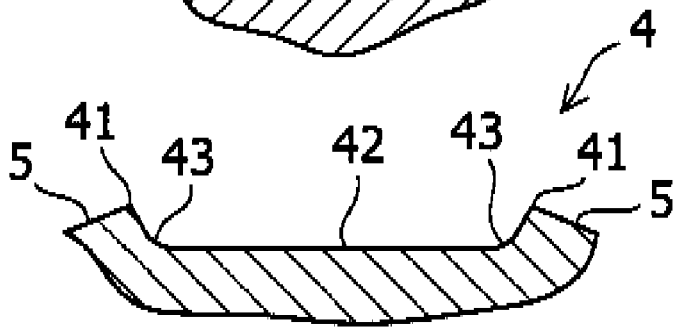
FIG. 4(B) is a sectional view taken along the line B-B of FIG. 2 in a first modification of a first embodiment.

FIG. 4(A) is a sectional view taken along the line A-A of FIG. 2 in a first modification of the first embodiment of the present invention. The A-A cross section is a transverse cross section cut perpendicularly to the longitudinal axis L. FIG. 4(B) is a sectional view taken along the line B-B of FIG. 2 in the first modification of the first embodiment of the present invention. The bottom part 42 is formed into a flat shape having a substantially uniform depth. Between the bottom part 42 and the contour 41, the curved part 43 is arranged. The curved part 43 is formed so as to be curved toward the center direction of the spherical surface 2 of the golf ball 1.

Therefore, the connecting dimple 4 has a characteristic shape due to the flat shaped bottom part 42. Thereby, the aesthetic appearance of the golf ball 1 can further be enhanced by the connecting dimples 4 configured as described above.

Figure 5A:
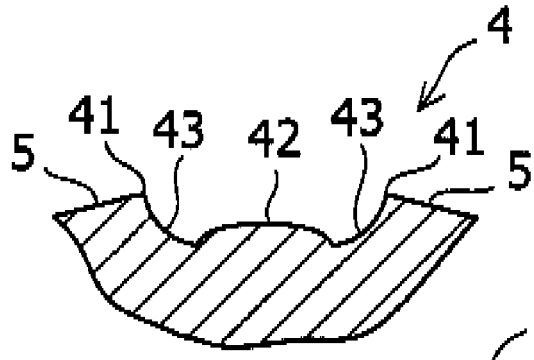
FIG. 5(A) is a sectional view taken along the line A-A of FIG. 2 in a second modification of a first embodiment.
Figure 5B:
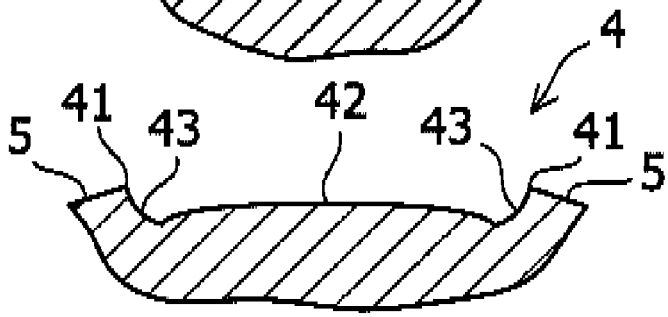
FIG. 5(B) is a sectional view taken along the line B-B of FIG. 2 in a second modification of a first embodiment.

FIG. 5(A) is a sectional view taken along the line A-A of FIG. 2 in a second modification of the first embodiment of the present invention. The A-A cross section is a transverse cross section cut perpendicularly to the longitudinal axis L. FIG. 5(B) is a sectional view taken along the line B-B of FIG. 2 in the second modification of the first embodiment of the present invention. The bottom part 42 is formed into a spherical surface shape of a spherical body having the center at a position approximately equal to the center of the spherical surface 2. Between the bottom part 42 and the contour 41, the curved part 43 is arranged. The curved part 43 is formed so as to be curved toward the center direction of the spherical surface 2 of the golf ball 1.

Therefore, in designing, the volume of the connecting dimples 4 can be changed by adjusting the radius of the spherical surface shape of the bottom part 42. By adjusting the radius of the spherical surface shape, even if the connecting dimple 4 has an intricate shape as in the present invention, the volume can be adjusted effectively for the golf balls having various structure. Thereby, the lift and the drag acting on the golf ball 1 when the golf ball is flied can be balanced easily, so that the flying performance of the golf ball 1 can be enhanced further.

Figure 6A:
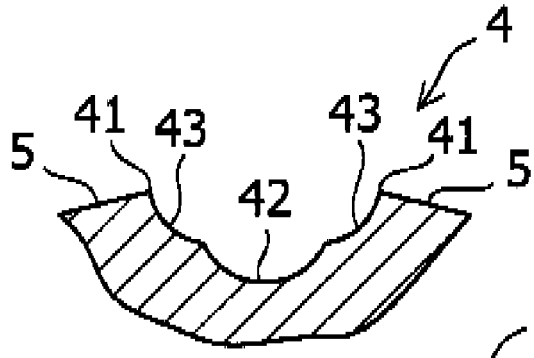
FIG. 6(A) is a sectional view taken along the line A-A of FIG. 2 in a third modification of a first embodiment.
Figure 6B:
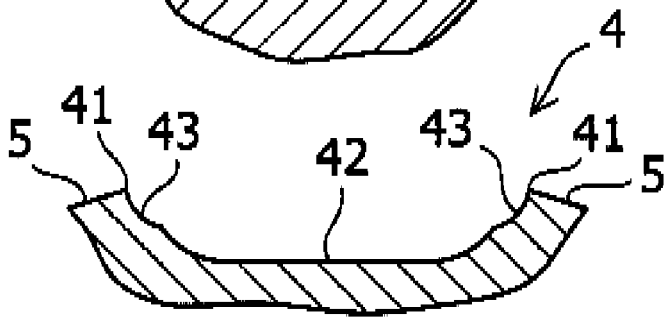
FIG. 6(B) is a sectional view taken along the line B-B of FIG. 2 in a third modification of a first embodiment.

FIG. 6(A) is a sectional view taken along the line A-A of FIG. 2 in a third modification of the first embodiment of the present invention. The A-A cross section is a transverse cross section cut perpendicularly to the longitudinal axis L. FIG. 6(B) is a sectional view taken along the line B-B of FIG. 2 in the third modification of the first embodiment of the present invention. The bottom part 42 is formed so as to be curved toward the center direction of the spherical surface 2 of the golf ball 1. Further, when viewed as the B-B cross section, the middle part of the bottom part 42 is formed so as to have a substantially uniform depth. Between the bottom part 42 and the contour 41, the curved part 43 is arranged. The curved part 43 is curved toward the center direction of the spherical surface 2, and is formed so as to be curved with a curvature different from the curvature of the curve of the bottom part 42.

According to this feature, by adjusting the radius of curvature of the curved shape of the bottom part 42, the lift and the drag can be balanced. Thereby, the balance of the lift and the drag acting on the golf ball 1 when the golf ball is flied can be adjusted effectively for the golf balls having various structures, so that the flying performance of the golf ball 1 can be enhanced. Due to the curved shape of the bottom part 42, the connecting dimple 4 has a characteristic shape. Thereby, the appearance of the golf ball 1 can be made characteristic by the above-described connecting dimple 4.

Figure 7A:
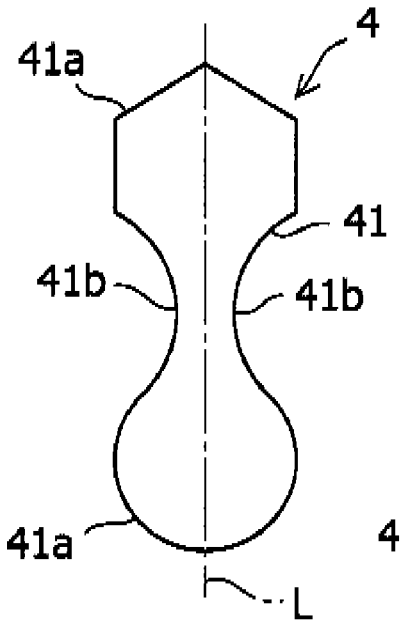
FIG. 7(A) is a schematic view showing a dimple in a second embodiment of the present invention in a plan view.

Next, a second embodiment of the present invention is explained. FIG. 7(A) shows the outline of the connecting dimple 4 in the second embodiment of the present invention in a plan view. The second embodiment has the same basic structure as that of the first embodiment or any of the first to third modifications of the first embodiment. Hereunder, parts that are different from those in the first embodiment and the first to third modifications of the first embodiment are explained. The contour 41 comprises the two contour main parts 41*a* and the two contour connecting parts 41*b*. One of the contour main parts 41*a* is formed into a substantially circular shape, and the other of them is formed into a noncircular and substantially hexagonal shape. The one contour main part 41*a* is arranged so as to be close to and face to the corner parts of the other contour main part 41*a* formed into a substantially hexagonal shape. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

By the above-described shape of the connecting dimple 4, excellent aerodynamic characteristics are provided, so that the flying performance of the golf ball 1 can be enhanced. The connecting dimple 4 has both of the characteristic shape emphasized by the noncircular contour main parts 41*a* and the streamline beauty emphasized by the noncircular contour main parts 41*a* and the curved contour connecting parts 41*b*. Therefore, by the connecting dimples 4 having such characteristics, the aesthetic appearance of the golf ball 1 can be improved further.

The other contour main part 41*a* may be formed into various shapes if it is noncircular. In the case where the other contour main part 41*a* is formed into a polygonal shape, one contour main part 41*a* may be arranged so as to be close to and face to the corner parts of the other contour main part 41*a* formed into a polygonal shape, or may be arranged so as to be close to and face to one side of the other contour main part 41*a* formed into a polygonal shape. Modifications of the second embodiment having the above-described contour 41 are explained below.

Figure 7B:
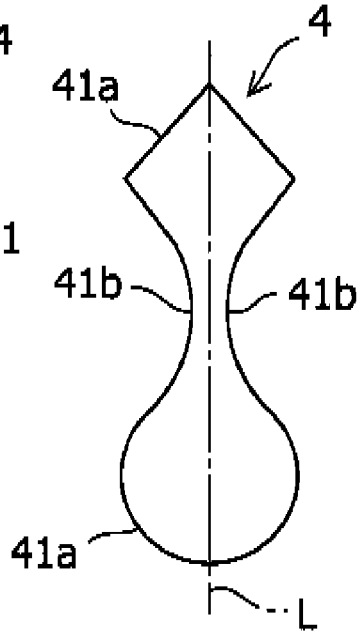
FIG. 7(B) is a schematic view showing a dimple in a first modification of a second embodiment of the present invention in a plan view.

FIG. 7(B) shows the outline of the connecting dimple 4 in a first modification of the second embodiment of the present invention in a plan view. One of the contour main parts 41*a* is formed into a substantially circular shape, and the other of them is formed into a substantially quadrilateral shape. The one contour main part 41*a* is arranged so as to be close to and face to the corner part of the other contour main part 41*a* formed into a substantially quadrilateral shape. The two contour connecting parts 41*b* connect the two contour main parts 41*a* to each other, and are formed so as to be curved toward the inside direction of the contour main parts 41*a* from the outermost points defined with the longitudinal axis L of the contour main parts 41 a being a reference.

Figure 7C:
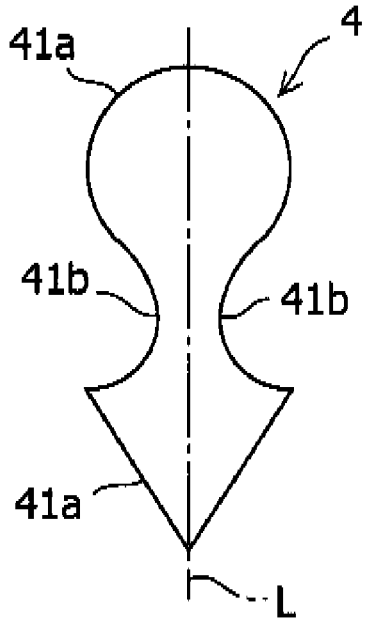
FIG. 7(C) is a schematic view showing a dimple in a second modification of a second embodiment of the present invention in a plan view.

FIG. 7(C) shows the outline of the connecting dimple 4 in a second modification of the second embodiment of the present invention in a plan view. One of the contour main parts 41*a* is formed into a substantially circular shape, and the other of them is formed into a substantially triangular shape. The one contour main part 41*a* is arranged so as to be close to and face to one side of the other contour main part 41*a* formed into a substantially triangular shape. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 7D:
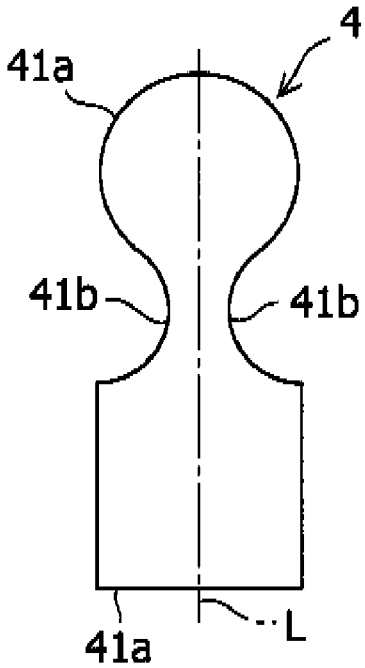
FIG. 7(D) is a schematic view showing a dimple in a third modification of a second embodiment of the present invention in a plan view.

FIG. 7(D) shows the outline of the connecting dimple 4 in a third modification of the second embodiment of the present invention in a plan view. One of the contour main parts 41*a* is formed into a substantially circular shape, and the other of them is formed into a substantially quadrilateral shape. The one contour main part 41*a* is arranged so as to be close to and face to one side of the other contour main part 41*a* formed into a substantially quadrilateral shape. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 7E:
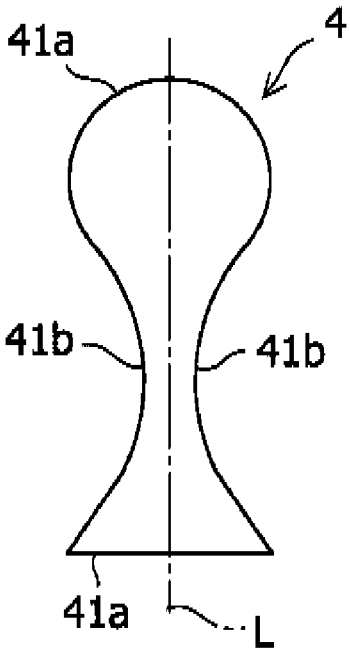
FIG. 7(E) is a schematic view showing a dimple in a fourth modification of a second embodiment of the present invention in a plan view.

FIG. 7(E) shows the outline of the connecting dimple 4 in a fourth modification of the second embodiment of the present invention in a plan view. One of the contour main parts 41*a* is formed into a substantially circular shape, and the other of them is formed into a substantially triangular shape. The one contour main part 41*a* is arranged so as to be close to and face to the corner part of the other contour main part 41*a* formed into a substantially triangular shape. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 8A:
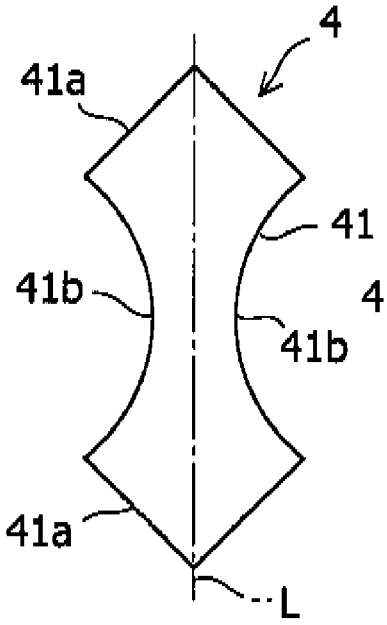
FIG. 8(A) is a schematic view showing a dimple in a third embodiment of the present invention in a plan view.

Next, a third embodiment of the present invention is explained. FIG. 8(A) shows the outline of the connecting dimple 4 in the third embodiment of the present invention in a plan view. The third embodiment has the same basic structure as that of the first embodiment or any of the first to third modifications of the first embodiment. Hereunder, parts that are different from those in the first embodiment and the first to third modifications of the first embodiment are explained. The contour 41 comprises the two contour main parts 41*a* and the two contour connecting parts 41*b*. The two contour main parts 41*a* each are formed into a noncircular and substantially quadrilateral shape, and are arranged so that the corner parts of the substantially quadrilateral shapes are close to each other and caused to face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

By the above-described shape of the connecting dimple 4, excellent aerodynamic characteristics are provided, so that the flying performance of the golf ball 1 can be enhanced. The connecting dimple 4 has both of the characteristic shape emphasized by the contour main parts 41*a* formed into the noncircular shape only and the streamline beauty emphasized by the contour connecting parts 41*b* formed into a streamline shape. Therefore, by the connecting dimples 4 having such characteristics, the aesthetic appearance of the golf ball 1 can be improved further.

The two contour main parts 41*a* may be formed into various shapes if they are noncircular and may be formed into different shapes each. In the case where the two contour main parts 41*a* each are formed into a polygonal shape, the two contour main parts 41*a* may be arranged so that the corner part of one contour main part 41*a* formed into a polygonal shape and one side of the other contour main part 41*a* formed into a polygonal shape are close to each other and face to each other. The two contour main parts 41*a* may be arranged so that the corner part of one contour main part 41*a* and the corner part of the other contour main part 41*a* are close to each other and face to each other. Further, the two contour main parts 41*a* may be arranged so that one side of one contour main part 41*a* and one side of the other contour main part 41*a* are close to each other and face to each other. Modifications of the third embodiment having the above-described contour 41 are explained below.

Figure 8B:
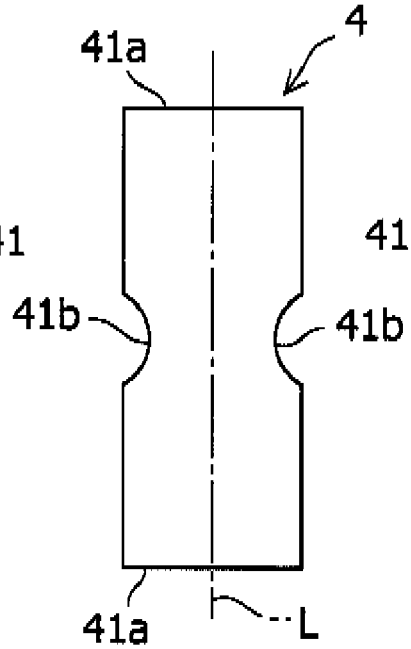
FIG. 8(B) is a schematic view showing a dimple in a first modification of a third embodiment of the present invention in a plan view.

FIG. 8(B) shows the outline of the connecting dimple 4 in a first modification of the third embodiment of the present invention in a plan view. The two contour main parts 41*a* each are formed into a substantially quadrilateral shape, and are arranged so that one side of one contour main part 41*a* formed into a substantially quadrilateral shape and one side of the other contour main part 41*a* formed into a substantially quadrilateral shape are close to each other and face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 8C:
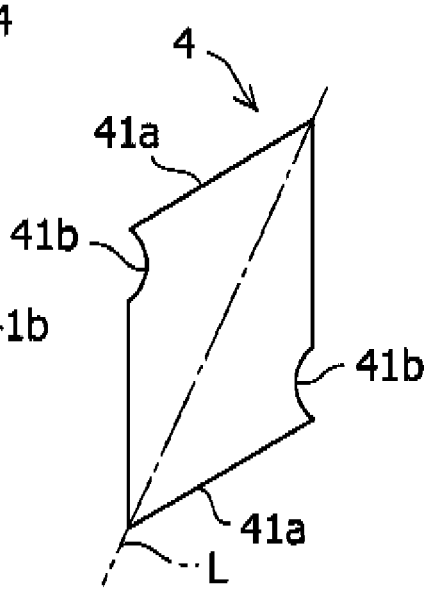
FIG. 8(C) is a schematic view showing a dimple in a second modification of a third embodiment of the present invention in a plan view.

FIG. 8(C) shows the outline of the connecting dimple 4 in a second modification of the third embodiment of the present invention in a plan view. The two contour main parts 41*a* each are formed into a substantially triangular shape, and are arranged so that one side of one contour main part 41*a* formed into a substantially triangular shape and one side of the other contour main part 41*a* formed into a substantially triangular shape are close to each other and face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 8D:
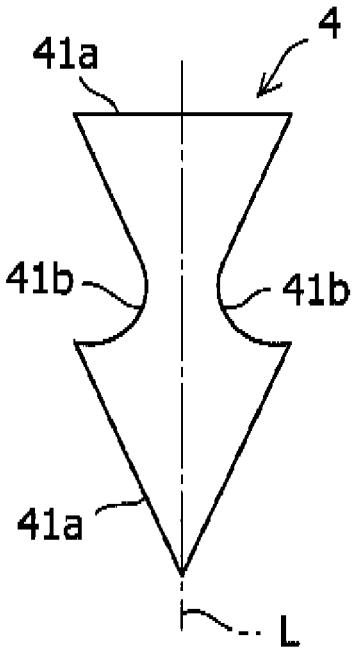
FIG. 8(D) is a schematic view showing a dimple in a third modification of a third embodiment of the present invention in a plan view.

FIG. 8(D) shows the outline of the connecting dimple 4 in a third modification of the third embodiment of the present invention in a plan view. The two contour main parts 41*a* each are formed into a substantially triangular shape, and are arranged so that the corner part of one contour main part 41*a* formed into a substantially triangular shape and one side of the other contour main part 41*a* formed into a substantially triangular shape are close to each other and face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 8E:
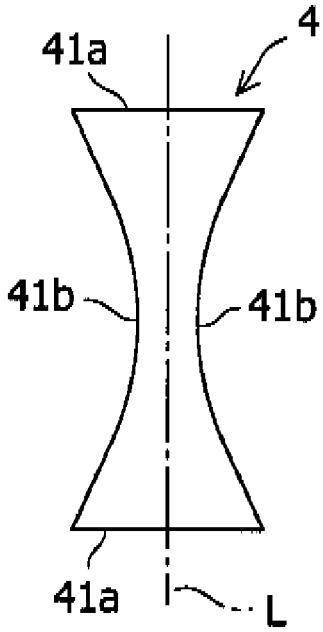
FIG. 8(E) is a schematic view showing a dimple in a fourth modification of a third embodiment of the present invention in a plan view.

FIG. 8(E) shows the outline of the connecting dimple 4 in a fourth modification of the third embodiment of the present invention in a plan view. The two contour main parts 41*a* each are formed into a substantially triangular shape, and are arranged so that the corner part of one contour main part 41*a* formed into a substantially triangular shape and the corner part of the other contour main part 41*a* formed into a substantially triangular shape are close to each other and face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Figure 8F:
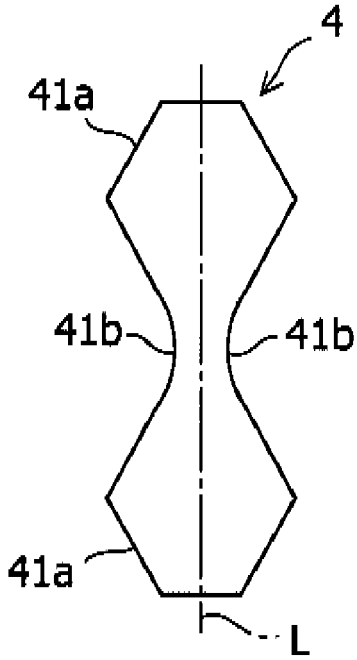
FIG. 8(F) is a schematic view showing a dimple in a fifth modification of a third embodiment of the present invention in a plan view.

FIG. 8(F) shows the outline of the connecting dimple 4 in a fifth modification of the third embodiment of the present invention in a plan view. The two contour main parts 41*a* each are formed into a substantially hexagonal shape, and are arranged so that one side of one contour main part 41*a* formed into a substantially hexagonal shape and one side of the other contour main part 41*a* formed into a substantially hexagonal shape are close to each other and face to each other. The two contour connecting parts 41*b* connect the two contour main parts 41*a* to each other, and are formed so as to be curved toward the inside direction of the contour main parts 41*a* from the outermost points defined with the longitudinal axis L of the contour main parts 41*a* being a reference.

Next, a fourth embodiment of the present invention is explained. In the fourth embodiment of the present invention, the number of the contour main parts 41*a* constituting the contour 41 is three or more, and the contour main parts 41*a* are connected to each other by the contour connecting parts 41*b*. In this case, the shapes of the three or more contour main parts 41*a* may be formed by circular shapes only as in the first embodiment, may be formed by appropriately combining circular shapes and noncircular shapes as in the second embodiment or in the first to fourth modifications of the second embodiment, or may be formed by noncircular shapes only as in the third embodiment or in the first to fifth modifications of the third embodiment. Further, the shape of the bottom part 42 may be the same as that in the first embodiment or in the first to third modifications of the first embodiment. The fourth embodiment can achieve the same effect as that of the embodiments described above and examples.

Next, a fifth embodiment of the present invention is explained. As the fifth embodiment of the present invention, a plurality of connecting dimples 4 may be arranged on the spherical surface 2 of the golf ball 1 by appropriately combining the connecting dimples 4 in the first embodiment, the first to third modifications of the first embodiment, the second embodiment, the first to fourth modifications of the second embodiment, the third embodiment, the first to fifth modifications of the third embodiment, and the fourth embodiment.

According to the fifth embodiment of the present invention, the area percentage of the connecting dimples 4 is increased, by which the flying performance of the golf ball 1 can be enhanced further. The appearance of the golf ball 1 becomes characteristic, and therefore the aesthetic appearance of the golf ball 1 can be improved further.

Although not especially described in the above-described embodiments and modifications, preferred features of the golf ball in accordance with the present invention are described below. The features described below do not restrict the present invention.

The golf ball 1 in accordance with the present invention is preferably a multiple solid golf ball such as a two-piece ball and a three-piece ball, a thread-wound golf ball, a one-piece golf ball, or the like.

To manufacture a molding die for the golf ball 1 in accordance with the present invention, there may be used a method in which the shape of the whole spherical surface 2 of the golf ball 1 is cut out three-dimensionally on a reversing master mold by using 3DCAD•CAM and then is transferred to a molding die, or a method in which the cavity part of a molding die is directly cut out three-dimensionally.

For the golf ball 1 in accordance with the present invention, the sum of the number of the circular dimples 3 and the number of the connecting dimples 4 is preferably about 150 to 500, further preferably about 200 to 450. The volume percentage of the circular dimples 3 and the connecting dimples 4 with respect to the total volume of the golf ball 1 is preferably about 0.9% to 1.6%, further preferably about 1.0% to 1.5%. In addition, the area percentage of the circular dimples 3 and the connecting dimples 4 with respect to the total area of the spherical surface 2 of the golf ball 1 is preferably about 70% to 89%.

Therefore, the area percentage of the circular dimples 3 and the connecting dimples 4 on the spherical surface 2 can be secured sufficiently, so that the flying performance of the golf ball 1 can be enhanced further.

For the golf ball 1 in accordance with the present invention, a ratio CL1/CL2 between a lift coefficient CL1 in the case where the golf ball 1 flies under a condition that the relationship between the Reynolds number and the spin speed is about Re 70000/2000 rpm and a lift coefficient CL2 in the case where the golf ball 1 flies under a condition of about Re 80000/2000 rpm is preferably a value higher than about 70%. A drag coefficient CD in the case where the golf ball 1 flies under a condition of about Re 180000/2520 rpm is preferably lower than about 0.225. The lift and the drag are balanced, by which the flying performance of the golf ball 1 can be enhanced further.

For the golf ball 1 in accordance with the present invention, the connecting dimples 4 are preferably arranged well-balancedly on the spherical surface 2 of the golf ball 1. Therefore, when the connecting dimples 4 are arranged on the spherical surface 2 of the golf ball 1, first, the spherical surface 2 is divided into a spherical polyhedron. As the spherical polyhedron, a spherical icosahedron obtained by dividing the spherical surface 2 into 20 surfaces, a spherical dodecahedron obtained by dividing the spherical surface 2 into 12 surfaces, a spherical octahedron obtained by dividing the spherical surface 2 into eight surfaces, and the like are available. On one divided surface formed by this division, a plurality of connecting dimples 4 are arranged in a fixed pattern. On other divided surfaces as well, the plurality of connecting dimples 4 are arranged in the same pattern as that on the above-described divided surface. By arranging the connecting dimples 4 in this manner, the connecting dimples 4 can be arranged well-balancedly on the spherical surface 2 of the golf ball 1, so that the flying performance of the golf ball 1 can be enhanced further.

For the golf ball 1 in accordance with the present invention, at least two contour main parts 41*a* are preferably formed so as to have an approximately equal size. In this case, the plurality of connecting dimples 4 are arranged well-balancedly on the whole of the spherical surface 2 of the golf ball 1, so that the flying performance of the golf ball 1 can be enhanced further.

The above is a description of the embodiments and modifications of the present invention. The present invention is not limited to the above-described embodiments and modifications, and any feature capable of achieving the effects of the present invention can be adopted appropriately.

For example, as a still another embodiment of the present invention, a plurality of circular dimples 3 may be formed so as to have an approximately equal size, or a plurality of connecting dimples 4 may be formed so as to have an approximately equal size. Thereby, the area percentage of the circular dimples 3 and the connecting dimples 4 can be increased. As a result, the flying performance of the golf ball 1 can be enhanced further.

As a still another embodiment of the present invention, the number of the circular dimples 3 and the number of the connecting dimples 4 may be changed appropriately, or the sizes of the circular dimples 3 and the sized of the connecting dimples 4 may be changed appropriately. The arrangement directions of the connecting dimples 4 may be changed appropriately. Such a change and combination are accomplished appropriately to various specifications required by the golf ball, by which the flying performance of golf balls of various specifications can be enhanced.

As a still another embodiment of the present invention, at least two contour main parts 41*a* are preferably formed so as to have different sizes. In this case, the connecting dimple 4 is formed into a characteristic shape by the difference in size between the contour main parts 41*a*, so that the golf ball 1 has a characteristic appearance. Therefore, the aesthetic appearance of the golf ball 1 provided with such connecting dimples 4 can be improved further.

Here, evaluation is performed to check the flying performance that the golf ball in accordance with the present invention has. Typical golf balls used for this evaluation are described below.

EXAMPLE 1

The golf ball 1 comprises the circular dimples 3 and the connecting dimples 4. The total number of the circular dimples 3 and the connecting dimples 4 is 330. Of these dimples, the number of the circular dimples 3 is 48, and the number of the connecting dimples 4 is 282. Of the forty-eight circular dimples 3, thirty-six circular dimples are large, and twelve circular dimples are small. Further, of the two hundred and eighty-two connecting dimples 4, six connecting dimples are especially large, two hundred and thirty-one connecting dimples are large, twenty-four connecting dimples each have a basic size, and thirty-six connecting dimples are small.

The area percentage SR of the circular dimples 3 and the noncircular connecting dimples 4 with respect to the total area of the spherical surface 2 of the golf ball 1 is about 70%. The volume percentage VR of the circular dimples 3 and the connecting dimples 4 with respect to the total volume of the golf ball 1 is about 1.43%.

The golf ball 1 formed into the above-described shape has a feature as shown in FIG. 1. The size of the circular dimple 3 is expressed as "large" and "small". The sizes of these circular dimples 3 are explained below. The term "large" represents that it is larger than "small". The size of the connecting dimple 4 is expressed as "especially large", "large", "basic size", and "small". These sizes are explained below. The term "especially large" represents that it is larger than "large", the term "large" represents that it is larger than "basic size", and the term "basic size" represents that it is larger than "small". Further, by referring to the appearance of the golf ball 1 shown in FIG. 1, these sizes can be judged.

EXAMPLE 2

Figure 9:
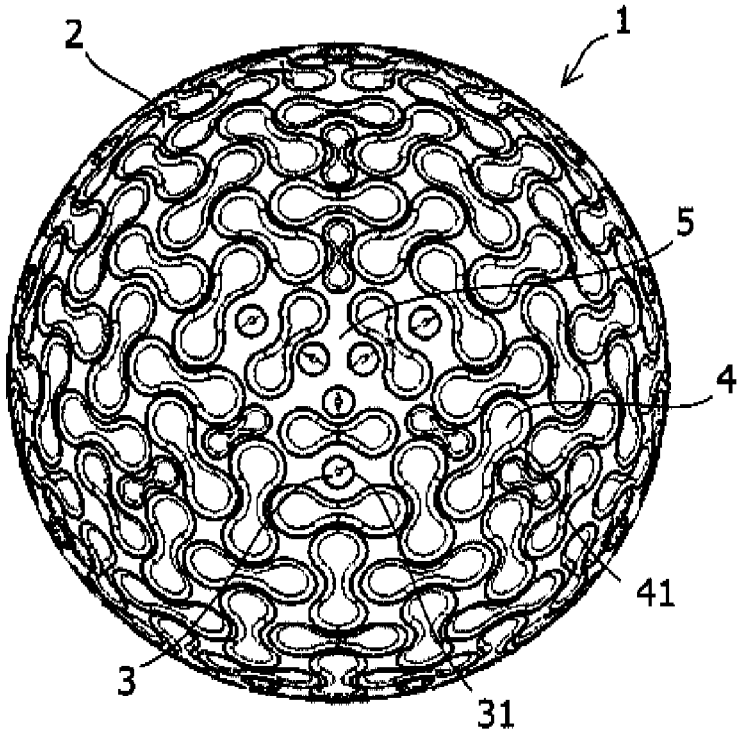
FIG. 9 is a schematic perspective view showing an appearance of a golf ball in example 2 of the present invention.

FIG. 9 shows the golf ball 1 of example 2. The golf ball 1 has the circular dimples 3 and the connecting dimples 4. The total number of the circular dimples 3 and the connecting dimples 4 is 228. Of these dimples, the number of the circular dimples 3 is 36, and the number of the connecting dimples 4 is 192. Of the thirty-six circular dimples 3, eighteen circular dimples are large, and eighteen circular dimples are small. Further, of the one hundred and ninety-two connecting dimples 4, ninety-six connecting dimples are large, forty-eight connecting dimples each have a standard size, and forty-eight connecting dimples are small.

The area percentage SR of the circular dimples 3 and the noncircular connecting dimples 4 with respect to the total area of the spherical surface 2 of the golf ball 1 is about 73%, and the volume percentage VR of the circular dimples 3 and the noncircular connecting dimples 4 with respect to the total volume of the golf ball 1 is about 1.44%.

The size of the circular dimple 3 is expressed as "large" and "small". The sizes of these circular dimples 3 are explained below. The term "large" represents that it is larger than "small". The size of the connecting dimple 4 is expressed as "large", "basic size", and "small". These sizes are explained below. The term "large" represents that it is larger than "basic size", and the term "basic size" represents that it is larger than "small". Further, by referring to the appearance of the golf ball 1 shown in FIG. 9, these sizes can be judged.

COMPARATIVE EXAMPLE 1

Figure 10:
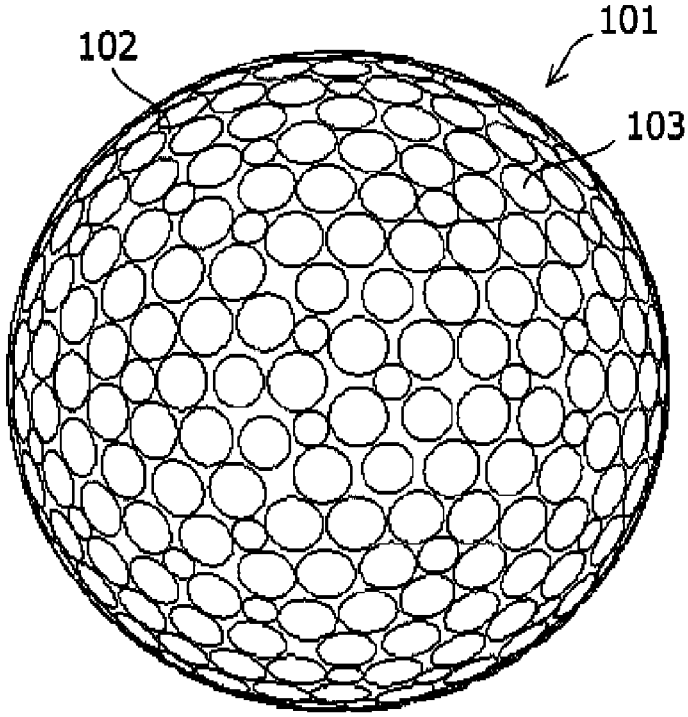
FIG.10 (PRIOR ART)
FIG. 10 is a schematic perspective view showing an appearance of a golf ball in comparative example 1 of the present invention.

FIG. 10 shows a golf ball 101 of comparative example 1. The golf ball 101 has a plurality of circular dimples 103 each formed into a depressed shape on a spherical surface 102 of the golf ball 101. The total number of the circular dimples 103 is 432. The area percentage SR of the circular dimples 103 with respect to the total area of the spherical surface 102 of the golf ball 101 is about 72%. The volume percentage VR of the circular dimples 3 with respect to the total volume of the golf ball 1 is about 1.33%.

The features of golf balls of example 1, example 2, and comparative example 1 are summarized in Table 1. For the golf balls of example 1, example 2, and comparative example 1, other conditions thereof are assumed to be the same.

TABLE 1

| | | Example 1 | Example 2 | Comparative example 1 |
|---|---|---|---|---|
| Total number of connecting dimples and circular dimples | | 330 | 228 | 432 |
| Total number of circular dimples | | 48 | 36 | — |
| Number of circular dimples | Large | 36 | 18 | — |
| | Small | 12 | 18 | — |
| Total number of connecting dimples | | 282 | 192 | — |
| Number of connecting dimples | Especially large | 6 | 0 | — |
| | Large | 216 | 96 | — |
| | Basic | 24 | 48 | — |
| | Small | 36 | 48 | — |
| Area percentage of dimples SR (%) | | 70 | 74 | 72 |
| Volume percentage of dimples VR (%) | | 1.43 | 1.44 | 1.33 |

Regarding the golf balls of example 1, example 2, and comparative example 1, the ratio CL1/CL2 between the lift coefficient CL1 in the case of about Re 70000/2000 rpm and the lift coefficient CL2 of about Re 80000/2000 rpm and the drag coefficient CD in the case where the golf ball flies at a high speed under a condition of about Re 180000/2520 rpm were calculated. The results as given in Table 2 were obtained.

TABLE 2

| | Example 1 | Example 2 | Comparative example 1 |
|---|---|---|---|
| Ratio CL1/CL2 between lift coefficient CL1 in the case of about Re 70000/2000 rpm and lift coefficient CL2 in the case of about Re 80000/2000 rpm | 80 | 85 | 65 |
| Drag coefficient CD in the case of about Re 180000/2520 rpm | 0.219 | 0.215 | 0.215 |

Table 3 reveals that in example 1 and example 2, the ratio CL1/CL2 between the lift coefficient CL1 in the case of about Re 70000/2000 rpm and the lift coefficient CL2 of about Re 80000/2000 rpm is higher than that in comparative example 1. The golf balls 1 of example 1 and example 2 provide a great lift, and therefore have enhanced flying performance when flying at a low speed.

Further, the golf balls of example 1, example 2, and comparative example 1 were hit with a driver (the No. 1 wood of golf club), and the flying distances of the hit balls at this time were measured. Specifically, the driver was attached to a hitting robot, and the golf balls were hit at a head speed of 45 m/s and at a delivery angle of 10° with this driver, and the carry and total flying distances of the hit balls were measured. The results obtained by this measurement are given in Table 3.

TABLE 3

| | | Example 1 | Example 2 | Comparative example 1 |
|---|---|---|---|---|
| Flying distance (m) | Carry | 217 | 218.5 | 215 |
| | Total | 229 | 230.5 | 225.5 |

Table 3 reveals that the carry and total flying distances in example 1 and example 2 are longer than those in comparative example 1.

The invention claimed is:

1. A golf ball on which a plurality of dimples are arranged on the spherical surface thereof, wherein each of the dimples has at least two contour main parts and contour connecting parts; and the at least two contour main parts are connected to each other by the contour connecting parts, and the contour connecting parts are formed so as to be curved inward from outermost points of the at least two contour main parts, wherein the contour connecting parts are narrower than the at least two contour main parts at a portion that is substantially centered between the at least two contour main parts, and wherein an entirety of each of the contour connecting parts is formed as a continuous curve.

2. The golf ball according to claim 1, wherein the at least two contour main parts are each formed in a circular shape.

3. The golf ball according to claim 1, wherein the at least two contour main parts are formed by a combination of a circular shape and a noncircular shape.

4. The golf ball according to claim 1, wherein the at least two contour main parts are each formed in a noncircular shape.

5. The golf ball according to claim 1, wherein a number of the dimples is about 150 to 500.

6. The golf ball according to claim 1, wherein a bottom part of each dimple is formed into a flat shape.

7. The golf ball according to claim 1, wherein a bottom part of each dimple is formed into a spherical surface shape.

8. A golf ball on which a plurality of dimples are arranged on the spherical surface thereof, wherein each of the dimples has at least two contour main parts and contour connecting parts;

the at least two contour main parts are connected to each other by the contour connecting parts, and the contour connecting parts are formed so as to be curved inward from outermost points of the at least two contour main parts; and a curved part is provided which is formed so as to be curved toward a center direction of the spherical surface between a periphery of the at least two contour main parts and a bottom part of a respective dimple and between a periphery of the contour connecting parts and the bottom part of the respective dimple, wherein the contour connecting parts are narrower than the at least two contour main parts at a portion that is substantially centered between the at least two contour main parts, and wherein an entirety of each of the contour connecting parts is formed as a continuous curve.

9. The golf ball according to claim 8, wherein the at least two contour main parts are each formed into a circular shape.

10. The golf ball according to claim 8, wherein the at least two contour main parts are formed by a combination of a circular shape and a noncircular shape.

11. The golf ball according to claim 8, wherein the at least two contour main parts are each formed into a noncircular shape.

12. The golf ball according to claim 8, wherein a number of the dimples is about 150 to 500.

13. The golf ball according to claim 8, wherein the bottom part is formed into a flat shape.

14. The golf ball according to claim 8, wherein the bottom part is formed into a spherical surface shape.

15. The golf ball according to claim 1, wherein the contour connecting parts are elongated.

16. The golf ball according to claim 8, wherein the contour connecting parts are elongated.

* * * * *